US006357781B1

(12) United States Patent
Jeandin

(10) Patent No.: US 6,357,781 B1
(45) Date of Patent: Mar. 19, 2002

(54) GLIDING OR ROLLING BOARD

(75) Inventor: Denis Jeandin, Sur les Marais (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/703,937

(22) Filed: Nov. 2, 2000

(30) Foreign Application Priority Data

Nov. 5, 1999 (FR) ..... 99 14207

(51) Int. Cl.[7] ..... A63C 5/04; B62B 9/04
(52) U.S. Cl. ..... 280/609; 280/14.22
(58) Field of Search ..... 280/609, 608, 280/602, 14.22

(56) References Cited

U.S. PATENT DOCUMENTS

| | | | | | |
|---|---|---|---|---|---|
| 1,440,565 | A | * | 1/1923 | Solbjor | 280/609 |
| 3,374,003 | A | * | 3/1968 | Fulsom | 280/609 |
| 3,933,360 | A | * | 1/1976 | Arai | 280/609 |
| 4,221,400 | A | * | 9/1980 | Powers | 280/602 |
| 4,533,150 | A | * | 8/1985 | Hardy | 280/609 |
| 5,143,395 | A | * | 9/1992 | Mayr | 280/602 |
| 5,158,318 | A | * | 10/1992 | Dittmar | 280/608 |
| 5,328,200 | A | * | 7/1994 | Pelizzari | 280/609 |
| 5,538,272 | A | | 7/1996 | Peart | 280/602 |
| 5,725,237 | A | * | 3/1998 | Krafft et al. | 280/609 |
| 5,727,807 | A | * | 3/1998 | Krafft et al. | 280/609 |
| D418,545 | S | * | 1/2000 | Cassel | D21/229 |
| 6,203,037 | B1 | * | 3/2001 | Wilson et al. | 280/87.042 |
| 6,217,041 | B1 | * | 4/2001 | Hauser et al. | 280/609 |

FOREIGN PATENT DOCUMENTS

| | | | | | |
|---|---|---|---|---|---|
| DE | 3200383 | A1 | * | 9/1982 | A63C/5/07 |
| DE | 4033235 | A1 | * | 5/1991 | A63C/5/044 |
| EP | 327367 | A2 | * | 8/1989 | A63C/5/04 |
| FR | 2652752 | | | 4/1991 | |
| FR | 2696354 | A1 | * | 4/1994 | A63C/5/14 |
| FR | 2770143 | | | 4/1999 | |
| JP | 5498831 | A | * | 8/1979 | A63C/5/07 |
| WO | WO-91/09653 | A1 | * | 7/1991 | A63C/5/07 |
| WO | WO-93/19824 | A1 | * | 10/1993 | A63C/5/04 |

* cited by examiner

*Primary Examiner*—Brian L. Johnson
*Assistant Examiner*—Joselynn Y Sliteris
(74) *Attorney, Agent, or Firm*—Greenblum & Bernstein, P.L.C.

(57) ABSTRACT

A gliding or rolling board that has a length, a width demarcated by a first lateral edge and a second lateral edge, and a thickness demarcated by an upper surface and a sole. At last a portion of the upper surface of the board has cavities, the portion being located along a lateral edge.

16 Claims, 3 Drawing Sheets

60
W3
72
63
65
66
73
W4
61
62
67
75
68
64
69
70
74
71

80
85
86
83
W5
W6
92
93
82
81
87
88
89
84
90
91

GLIDING OR ROLLING BOARD

BACKGROUND OF THE INVENTION

1. Field of the Invention

The present invention relates to the field of gliding or rolling boards adapted to snowboarding, skiing, skate boarding, or the like.

2. Description of Background and Relevant Information

A board has a length, a width, and a thickness. When snowboarding, both of the user's feet are affixed to an upper surface of the board, the feet being oriented substantially along a transverse direction with respect to the board.

The sport requires that the user perform jumps, figures, or acrobatic maneuvers. That is the case, for example, in competitions which require figures of style.

As a result, the user sometimes has to grab an edge of the board with one hand.

It is then necessary that the hand be capable of holding the edge of the board without slipping, so tat the user can control his/her balance or the movement of his/her body with respect to the board.

On most known boards, the upper surface is hard and smooth, just as the gliding surface, the latter being opposite the upper surface with respect to the thickness of the board. The upper surface is hard and smooth because it is formed of a layer of a material that protects, in particular, against impacts, friction, or ultraviolet radiation.

Because the gliding surface is also smooth, the hand that holds the edge tends to slide along the latter.

The prior art has proposed solutions to enable a manual grip of an edge.

For example, French Patent Publication No. 2 652 752 discloses the use of at least one beading forming a handle. Each beading is arranged so as to be located on one side of the board, in order to facilitate the manual grip of the edge. The beading indeed enables a good grip.

However, the board according to French Patent Publication 2 652 752 has the following disadvantages. Initially, the beading increases the weight of the board, which makes it more difficult to perform jumps, figures, or acrobatic maneuvers.

Moreover, in the form of a snowboard, snow tends to adhere to the beading, which hinders the grip and further increases the weight of the board.

SUMMARY OF THE INVENTION

An object of the invention is to enable the user to have a good manual grip of an edge, without the weight of the board being increased.

To this end, the invention proposes a gliding or rolling board that extends along a longitudinal direction between a first end and a second end, the board having a width demarcated by a first lateral edge and a second lateral edge, and a thickness demarcated by an upper surface and a lower surface or gliding sole, the board successively having, between the first end and second end, a first end zone, a first contact line, a first intermediate zone, a retaining zone, a second intermediate zone, a second contact line, and a second end zone.

At least a portion of the upper surface of the board of the invention has cavities, the portion being located along a lateral edge.

The cavities render the upper surface rough at in the area of this portion. As a result, the user can hold the edge of the board with the hand, without the latter sliding along the board.

The good grip of the edge with the hand is had without the weight of the board being increased. An advantage is that the user can more easily control his/her balance or the movements of his/her body with respect to the board.

BRIEF DESCRIPTION OF DRAWINGS

Other characteristics and advantages of the invention will be better understood from the description that follows, with reference to the annexed drawings showing, by way of non-limiting examples, how the invention can be embodied, and in which.

DETAILED DESCRIPTION OF THE INVENTION

Although the examples proposed hereinafter relate to the field of snowboarding, the invention is not limited to this field and also relates to the fields of skiing, roller skating, skate boarding, or the like.

The first embodiment of the invention is described hereinafter with reference to FIGS. 1–5.

Figure 1:
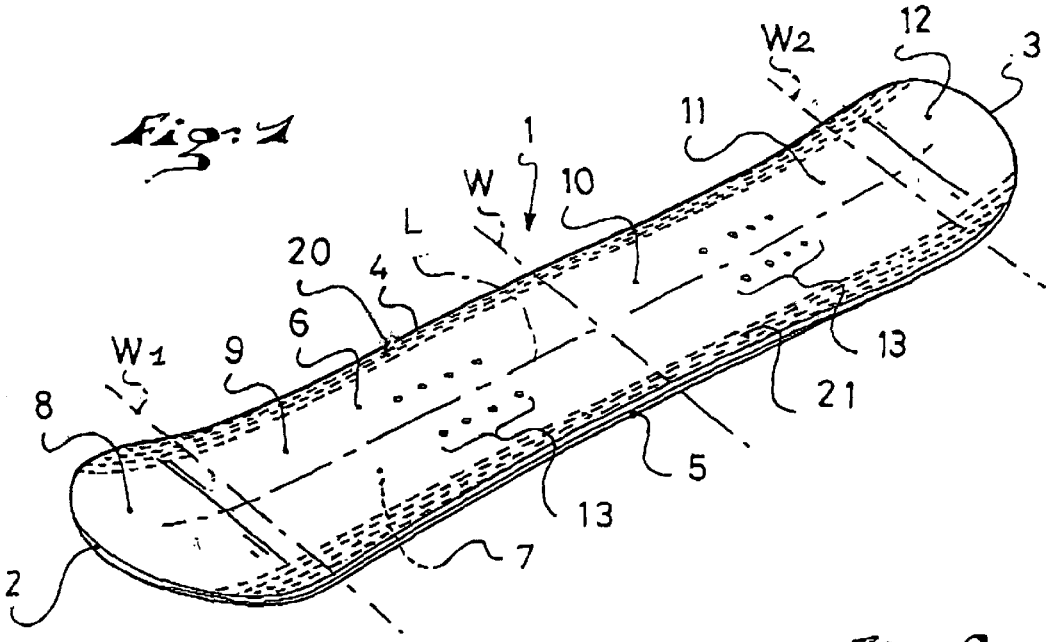
FIG. 1 is a perspective view of a board according to the invention according to a fist embodiment.
Figure 2:
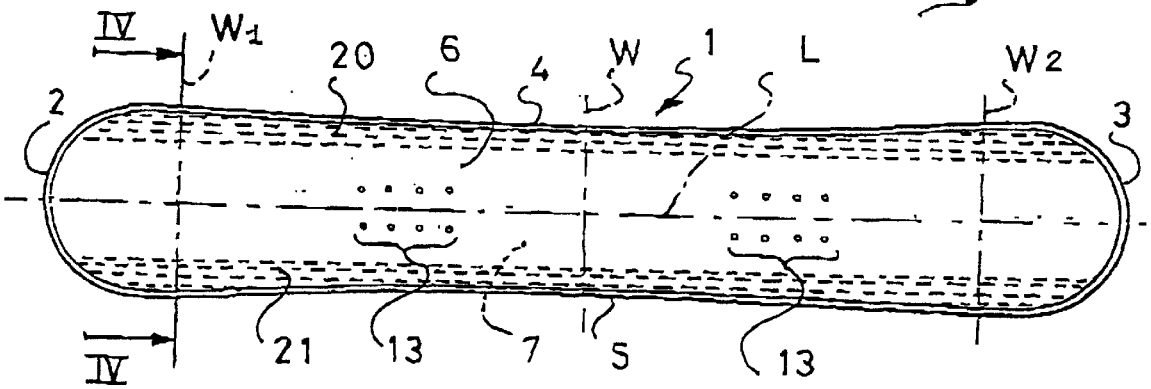
FIG. 2 is a top view of the board according to FIG. 1.

In a known manner, as shown in FIGS. 1 and 2, a board 1 extends along a longitudinal axis L between a first end 2 and a second end 3. The board 1 has a width demarcated by a first lateral edge 4 and a second lateral edge 5, as well as a thickness demarcated by an upper surface 6 and a lower surface or gliding sole 7.

The-board 1 successively has, between the first end 2 and second end 3, a first end zone 8, a first contact line W1, a first intermediate zone 9, a retaining zone 10, a second intermediate zone 11, a second contact line W2, and a second end zone 12.

The retaining zone 10 is provided to receive devices for retaining the user's feet, the devices not being shown for reasons of convenience. To be able to affix the devices to the board 1, two sets of threaded holes 13 are provided, by way of non-limiting example. Each set makes it possible to retain a device on the board 1 in a desired position.

Figure 3:
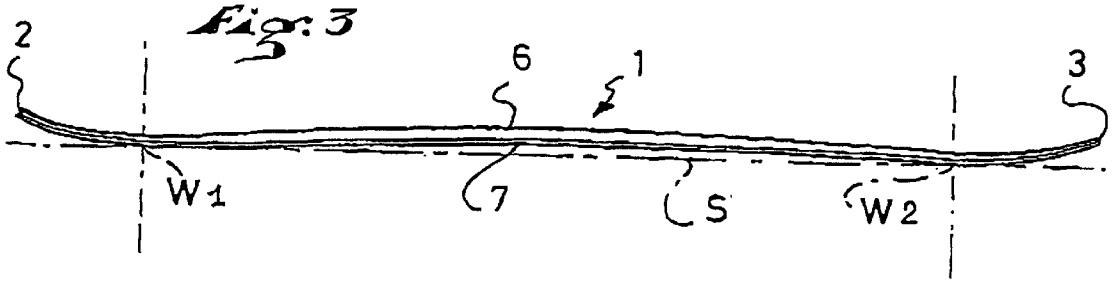
FIG. 3 is a side view of the board according to FIGS. 1 and 2.

As can be clearly understood from FIG. 3, a contact line is to be understood as being a substantially transverse line in the area of which the board 1 is in contact with a planar surface S, when the sole 7 is placed on the surface S.

Figure 4:
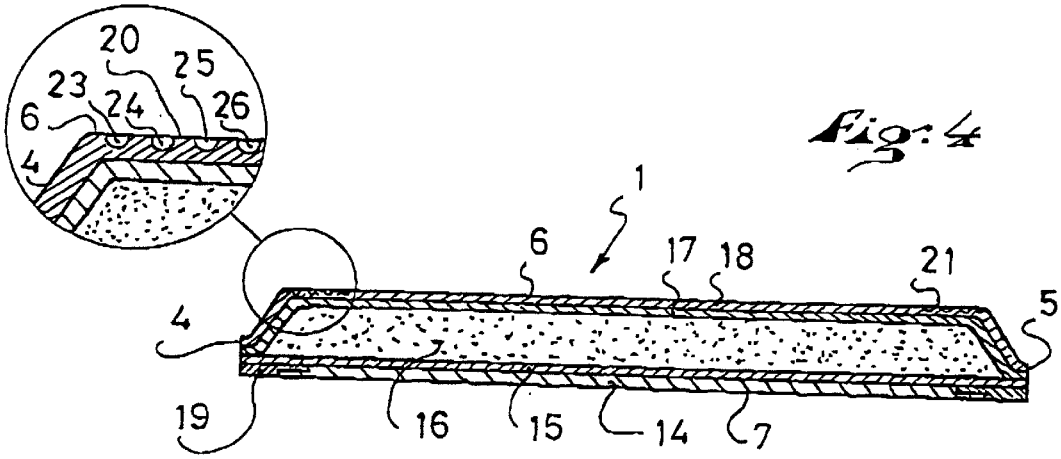
FIG. 4 is a cross-section along the line IV—IV of FIG, 2.

As shown in FIG. 4, the thickness of the board 1 has a structure that is known to a person with ordinary skill in the art.

From the sole 7 to the upper surface 6, the thickness is formed by a stack including a gliding layer 14, a lower reinforcement 15, a core 16, an upper reinforcement 17, and a protective layer 18.

The core 16 can be made of wood, in a foam made of plastic, with a honeycombed material, or the like.

The reinforcements 15, 17 are preferably made with a resin impregnated fiber cloth. The fibers can be glass fibers, carbon fibers, or the like. The resin can be a thermoforming or thermosetting resin.

The protective layer is preferably made from a compound including acetyl-butadiene-styrene.

Finally, the sole is made of a material that includes polyethylene.

In a known manner, the agog of the constituent elements of the stack is done by positioning in a mold, followed by an increase in temperature and pressure to given values, during a predetermined period.

The board preferably includes a peripheral running edge 19 that is placed in a mold with the other elements. Its shape is substantially symmetrical with respect to a transverse axis W visible in FIG. 1, the axis W being located in the middle of the ends 2 and 3. The shape of the board 1 is also symmetrical with respect to the axis L that is located in the middle of the lateral edges 4, 5.

According to the invention, at least a portion of the upper surface 6 has cavities that open up on the upper surface 6.

According to the first embodiment, as seen particularly in FIGS. 1 and 2, the board 1 has a first portion 20 located along the first lateral edge 4, as well as a second portion 21 located along the second lateral edge 5.

In these two figures of the drawings, the cavities of the portions 20, 21 are shown in dotted lines, for reasons of convenience, because the size of a cavity is reduced with respect to the size of the board.

Indeed, the board 1 has a length comprised between 1.2 and 1.7 meters, and a width that can vary from 20 to 30 centimeters.

By contrast, each cavity has a length comprised between 5 and 30 millimeters, and a width comprised between 0.2 and 3.0 millimeters.

Figure 5:
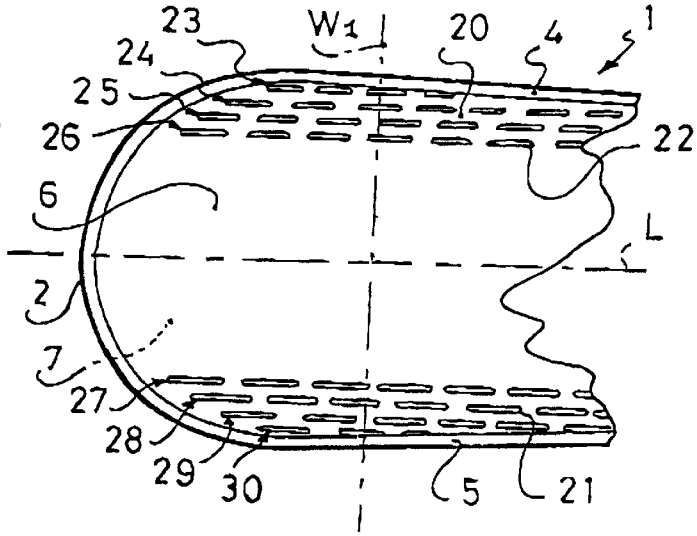
FIG. 5 is an enlarged partial view of FIG. 2.

The enlargement of FIG. 5 shows the arrangement of the cavities better. For example, the cavity 22 of the first portion 20 has an oblong shape, its length being substantially parallel to the longitudinal axis L of the board 1.

Similarly, all of the cavities are oriented such that their length is substantially parallel to the longitudinal axis L.

The first portion 20 has four cavity lines 23, 24, 25 and 26, and the second portion 21 also has four cavity lines 27, 28, 29, and 30.

Each cavity line is to be understood as being a series of aligned cavities, the space separating two successive cavities being comprised between 1 and 15 millimeters, along the longitudinal axis L.

The distance separating two lines of the same portion, measured along the width of the board 1, is comprised between 1 and 10 millimeters.

As shown in FIG. 2, for example, each of the portions 20, 21 extends substantially over the entire length of the board 1. Thus, the user can grip an edge along the entire length of the board.

As clearly shown in FIG. 4, the cavities are formed in the thickness of the protective layer 18.

This characteristic is clearly visible in the enlarged first portion 20. Each cavity has a depth of several tenths of a millimeter, without extending through the thickness of the protective layer 18. Thus, the contact surface between the reinforcement 17 and protective 18 layers is continuous. The cavities are preferably made by the mold that enables the assembly of the constituent elements of the board. It is adequate that the portion of the mold facing the protective layer 18 have projecting reliefs each having the shape of a cavity.

The rise in temperature causes a softening of the constituent material of the protective layer 18 to form the cavities.

The second embodiment of the invention is presented hereinafter by means of FIG. 6. It is described summarily because it is similar to the first embodiment.

A board 40 has in particular an upper surface 41, a sole 42, a fist lateral edge 43 and a second lateral edge 44. The thickness of the board 40 includes a gliding layer 45, a lower reinforcement 46, a core 47, an upper reinforcement 48, and a protective layer 49.

Figure 6:
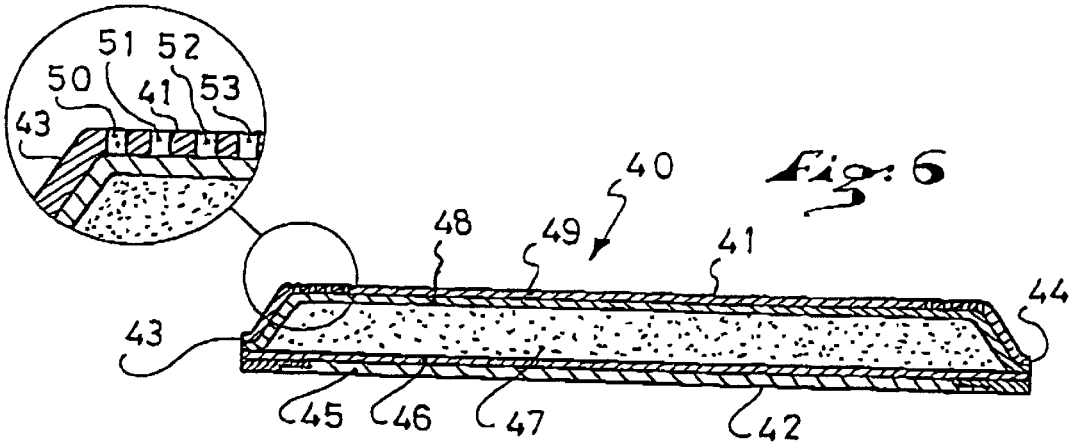
FIG. 6 is a cross-section similar to the cross-section of FIG. 4, but corresponds to a second embodiment.

As is understood by means the enlarged portion of FIG. 6, each cavity of the protective layer 49 has a depth that is equal to the thickness of the protective layer 49. This is especially the case of the cavities 50, 51, 52, and 53.

These cavities are obtained by a cutting of the protective layer 49 prior to the positioning of the constituent elements of the board 40 in a mold. To t end, the protective layer 49 can be machined or stamped. An advantage resulting from this technique is that the same mold can be used to make boards whose upper surface is smooth, or boards whose upper surface has cavities.

Figure 7:
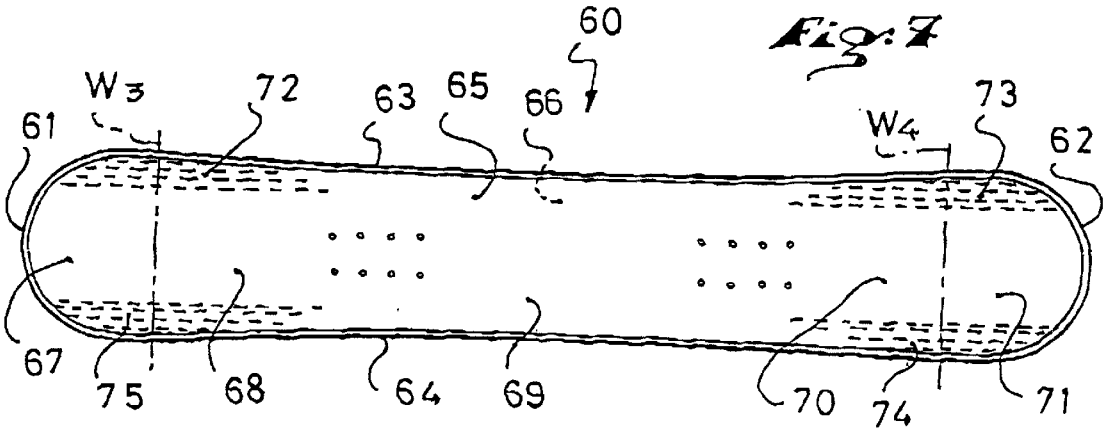
FIG. 7 is a top view of a board according to a third embodiment.

The third embodiment of the invention is presented hereinafter by means of FIG. 7.

A board 60 has in particular a first longitudinal end 61, a second longitudinal end 62, a first lateral edge 63, a second lateral edge 64, an upper surface 65, a sole 66.

The board 60 also has, from the first end 61 to the second end 62, a first end zone 67, a first contact line W3, a first intermediate zone 68, a retaining zone 69, a second intermediate zone 70, a second contact line W4, and a second end zone 71.

All these portions of the board 60 are similar to those of the boards 1 and 40 previously described.

Four portions 72, 73, 74, and 75 of the upper surface 65 have cavities similar to the cavities of the previous embodiments.

Each of the portions 72, 73, 74, 75 is located along a lateral edge 63, 64, and extends on both sides of a contact line W3, W4, i.e., in an end zone 67, 71, and in an intermediate zone 68, 70.

This configuration enables a good manual grip of an edge in the area of the contact lines.

Figure 8:
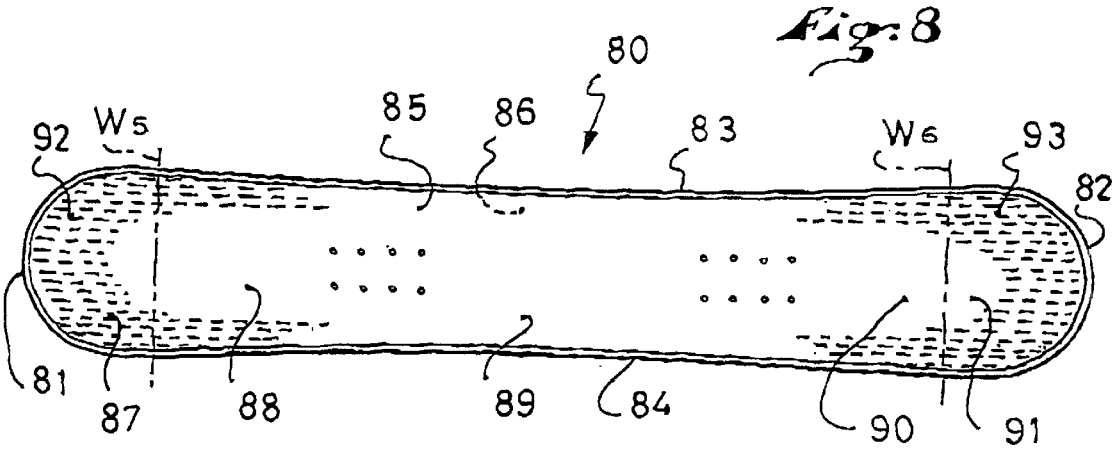
FIG. 8 is a top view of a board according to a fourth embodiment..

The fourth embodiment of the invention is presented hereinafter by means of FIG. 8.

A board 80 has in particular a first longitudinal end 81, a second longitudinal end 82, a first lateral end 83, a second lateral end 84, an upper surface 85, a sole 86.

The board 80 also has, from the first end 81 to the second end 82, a fit end zone 87, a first contact line W5, a first intermediate zone 88, a retaining zone 89, a second intermediate zone 90, a second contact line W6, and a second end zone 91.

Furthermore, these portions of the board 80 are similar to those of the boards 1, 40, and 60 previously described.

Two portions 92, 93 of the upper surface 85 have cavities that are to the cavities of the preceding embodiments.

Each of the portions 92, 93 is located partially in an end zone and in an intermediate zone. For example, the portion 92 extends in the area of each of the edges 83, 84 on both sides of the contact line W5, on the one hand, and to the area of the end 81, on the other hand.

This configuration enables a good manual grip of an edge in the area of the end zone, i.e., in die rounded portion of each of the edges 83, 84.

The invention is not intended to be limited to the embodiments thus described, and includes all of the technical equivalents that fail within the scope of the claim that follow.

For example, the cavities can have various shapes, such as that of a circle, triangle, square, polygon, or any other complex form.

The shapes of the cavity portions can also be diverse, and can be arranged asymmetrically on the upper surface.

It can be provided that the cavities be obtained by thermoforming. In his case, a tool is heated to a sufficiently high temperature to melt the protective layer. Then, this tool is placed in contact with the protective layer to create the cavities. The heat released by the tool makes it possible to deform the protective layer to create the cavities, because the constituent material of the protective layer becomes locally fluid.

It can also be provided that the cavities be obtained by the corrugated aspect of the upper surface. In this case, a portion has alternating recesses and projections. The bottom of a cavity is not necessarily closer to the core than the remainder of the upper surface.

This application is based upon French Patent Application No. 99 14207, filed Nov. 5, 1999, the disclosure of which is hereby incorporated by reference thereto in its entirety, and the priority of which is hereby claimed under 35 USC §119.

What is claimed is:

1. A board for a gliding or rolling sport, said board comprising:

a board comprising an upper protective layer, an upper reinforcement layer beneath said protective layer, and a lower gliding sole, said board extending along a longitudinal direction between a first end and a second end, the board having a width demarcated by a first lateral edge and a second lateral edge, and a thickness demarcated by an upper surface and a lower surface, said upper surface comprising an upper surface of said protective layer and said lower surface comprising a lower surface of said gliding sole, the board successively having, between the first end and second end, a first end zone, a first contact line, a first intermediate zone, a remaining zone, a second intermediate zone, a second contact line, and a second end zone, at least one portion of the upper surface having cavities, the portion being located along a lateral edge, said cavities having a depth contained within said protective layers, said cavities not penetrating into said upper reinforcement layer.

2. A board according to claim 1, wherein said portion extends substantially along the entire length of the board.

3. A board according to claim 1, wherein the board further has a portion located along each of the lateral edges.

4. A board according to claim 1, wherein each of said at least one portion has a plurality of cavity lines.

5. A board according to claim 1, wherein each of said cavities has a length of approximately 10 mm, a width of approximately 0.5 mm, and a depth of approximately 0.5 mm.

6. A board according to claim 2, wherein the board further has a portion located along each of the lateral edges.

7. A board according to claim 2, wherein each of said at least one portion has a plurality of cavity lines.

8. A board according to claim 3, wherein each of said at least one portion has a plurality of cavity lines.

9. A board according to claim 1, wherein the board has a length of between 1.2 and 1.7 meters.

10. A board according to claim 9, wherein the board has a width varying along the length of 20 to 30 centimeters.

11. A board according to claim 1, wherein each of said cavities has a length of between 5 and 30 millimeters and a width of between 0.2 and 3.0 millimeters.

12. A board according to claim 2, wherein each of said cavities has a length of between 5 and 30 millimeters and a width of between 0.2 and 3.0 millimeters.

13. A board according to claim 3, wherein each of said cavities has a length of between 5 and 30 millimeters and a width of between 0.2 and 3.0 millimeters.

14. A board according to claim 4, wherein each of said cavities has a length of between 5 and 30 millimeters and a width of between 0.2 and 3.0 millimeters.

15. A board according to claim 1, wherein longitudinal spacing between two successive ones of said cavities is between 1 and 15 millimeters.

16. A board according to claim 1, wherein longitudinal spacing of pluralities of successive ones of said cavities is between 1 and 15 millimeters.

* * * * *